US006949034B2

(12) United States Patent
Vitello et al.

(10) Patent No.: US 6,949,034 B2
(45) **Date of Patent: *Sep. 27, 2005**

(54) BASKETBALL SHOOTING TRAINER AND METHOD

(75) Inventors: John J. Vitello, Cheshire, CT (US); Paul J. Vitello, Wallingford, CT (US)

(73) Assignee: Vi-Able, LLC, Meriden, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/375,446

(22) Filed: Feb. 27, 2003

(65) Prior Publication Data

US 2003/0224881 A1 Dec. 4, 2003

Related U.S. Application Data

(63) Continuation-in-part of application No. 10/049,927, filed as application No. PCT/US00/22614 on Aug. 18, 2000, now Pat. No. 6,679,794.

(60) Provisional application No. 60/360,200, filed on Feb. 27, 2002, and provisional application No. 60/150,059, filed on Aug. 20, 1999.

(51) Int. Cl.[7] ..... A63B 69/00

(52) U.S. Cl. ..... 473/433; 473/422

(58) Field of Search ..... 473/433, 429, 473/415, 417, 422, 450, 447, 448, 449, 438, 416, 458; 600/587; 482/96

(56) References Cited

U.S. PATENT DOCUMENTS

| | | | | | |
|---|---|---|---|---|---|
| 4,538,808 | A | * | 9/1985 | Holland | 473/447 |
| 4,623,148 | A | | 11/1986 | Juhl | 273/1.5 |
| 4,717,149 | A | | 1/1988 | Juhl | 273/1.5 |
| 4,742,832 | A | * | 5/1988 | Kauffmann et al. | 600/587 |
| 5,080,351 | A | * | 1/1992 | Rockwell | 482/138 |
| 5,324,026 | A | | 6/1994 | Conlon et al. | 273/1.5 |
| 5,330,405 | A | * | 7/1994 | Habing et al. | 482/96 |
| 5,599,016 | A | | 2/1997 | Larkin | 473/448 |
| 5,833,556 | A | | 11/1998 | Ferrari | 473/448 |
| 6,679,794 | B1 | * | 1/2004 | Vitello et al. | 473/433 |

OTHER PUBLICATIONS

Web page, Basketballbin, 2001, Downloaded Jan. 18, 2005, www.basketballbin.com, 2 pages.*

* cited by examiner

*Primary Examiner*—Gregory Vidovich
*Assistant Examiner*—M. Chambers
(74) *Attorney, Agent, or Firm*—Wiggin and Dana LLP; Gregory S. Rosenblatt; Anthony P. Gangemi

(57) ABSTRACT

An apparatus is used to implement a method for training a person to accomplish a basketball shot. A lower body positioning member is located in front of a leg area of the person when that person is in a position to attempt the shot. When the person so attempts the shot, the lower body positioning member restrains forward rotation of the person's leading shin. An upper body positioning member is located in front of a torso area of the person. When the person attempts the shot, the upper body positioning member restrains downward rotation of the person's shooting arm. In a repetitive process, the person is provided with a basketball and shoots the basketball at the goal. By this repetitive process the person learns to accomplish the shot without excessive rotation of the lower leg and upper arm.

21 Claims, 9 Drawing Sheets

BASKETBALL SHOOTING TRAINER AND METHOD

CROSS-REFERENCE TO RELATED APPLICATIONS

This patent application claims priority to U.S. Provisional Patent Application Ser. No. 60/360,200, entitled "BASKETBALL SHOOTING TRAINER AND METHOD" that was filed on Feb. 27, 2002, the disclosure of which is incorporated by reference in its entirety herein as if set forth at length. This patent application is a continuation-in-part of U.S. patent application Ser. No. 10/049,927, filed Feb. 20, 2002, now U.S. Pat. No. 6,679,794, a U.S. National Phase filing of International Patent Application No. PCT/US00/22614, filed Aug. 18, 2000, both entitled "BASKETBALL SHOOTING TRAINER AND METHOD." This application is also related to U.S. Provisional Patent Application Ser. No. 60/150,059 filed on Aug. 20, 1999, entitled "BASKETBALL SHOOTING TRAINER AND METHOD." The disclosures of the aforementioned U.S. and international patent applications are incorporated by reference in their entireties.

BACKGROUND OF THE INVENTION

1. Field of the Invention

This invention relates to basketball, and more particularly to a method and apparatus for training a person to shoot free-throws.

2. Description of the Related Art

A key aspect of the basketball free-throw or foul shot is the consistent environment presented to the player. From court to court, the distances involved in making the shot is entirely consistent as are the particular properties of the equipment and environment largely relevant to accomplishing the shot. The absence of a defender attempting to block the shot removes any strategy considerations. Therefore, the ability to successfully make free-throws is a highly trainable skill. The most common method of training for free-throws is simple unaided repetition. Unaided repetition is highly inefficient and has sporadic results.

In attempts to increase training efficiency and improve training results, a variety of techniques and associated equipment have been developed. Few of the previously presented equipment is in common use. There have been a number of patented brace-like structures configured to be worn on the user's arm to restrict or otherwise guide motion (typically of the wrist) in a desired fashion. These orthotic structures appear to be awkward, address a limited aspect of the shooting motion, are not specifically tailored to foul shooting, and suffer from the inherent deficiency that their weight and restriction train the users to shoot under different circumstances than are actually encountered in a game. Other patented training devices involve fixed structures which have a mechanically-guided mock basketball and, appear to resemble exercise equipment. Such machines can only aspire to mimic the "feel" of shooting a basketball, and are no substitute for the actual thing.

U.S. Pat. No. 5,599,016 shows a free-standing device which is purported to develop muscle memory relative to proper hand, wrist, and arm movement, and, in particular to the follow through of the shooting hand after release of the basketball. This involves positioning a rectangular structure above the head of the user so that the user is forced to project the basketball through an aperture in the structure. This device fails to address what we believe are the key aspects of the movements involved in proper foul shooting and further fails to provide instructional feedback to the user.

We have come to observe and understand much about free-throw shooting techniques both good and bad. Because of the uniform circumstances presented by the free-throw, other than a small inherent randomness, the causes of shooting inaccuracy rest entirely with the player, technique, and training. By minimizing potential sources of such inaccuracy, the player's free-throw shooting percentage can be increased. Most, if not all, competitive basketball players at the junior high school, high school, college, and professional levels have sufficient hand/wrist strength to accomplish a free-throw with relatively slight movement of the upper torso and even less movement of the legs. Nevertheless, even some professional players go through very extreme movements during free-throw shooting. In particular, the player often starts standing erect and then initiates a cocking or setting movement: squatting with their legs; lowering their shooting arm so that the shooting elbow is significantly below the shoulder; and flexing that elbow outward. To attempt the shot, the player simultaneously extends his or her legs and shooting arm, bringing their elbow inward as the arm extends.

We believe this extreme range of motion presents a significant source of shooting inaccuracy. At a first level, the greater range of motion from the set point to the release point increases the likelihood that the shooter's release position, speed, and the like may be other than optimal. At a second level, however, this is exacerbated by the fact that the longer range of motion puts the shooter in positions where he or she is more likely to be affected by fatigue. In particular, fatigued legs will greatly affect the amount of propulsion provided by the legs if the shooter makes a deep squat to the set position prior to shooting. Also, lowering of the shooting arm tends to bring the ball down to or below the level of the player's chin. As the player extends his or her shooting arm the ball passes in front of the player's face, moving through the line of sight to the rim so that the player must refocus on the rim as the shot is taken.

SUMMARY OF THE INVENTION

We have accordingly provided a method for teaching a player to shoot free-throws with a shooting technique configured to minimize sources of error and the effects of fatigue, thereby, maximizing accuracy. To implement this method, we have designed an apparatus which, while confining the practicing player to a desired range of motion, does so in such a way that the player ultimately experiences the exact same sensory inputs as in the absence of the apparatus.

Accordingly, in one aspect the invention is directed to a device for training a person to accomplish a basketball shot, by way of example a foul shot. The device includes a generally vertically extending frame and a horizontally extending support, supporting the frame. A lower body positioning member is supported by the support or the frame and is located in front of a leg area of the person when that person is in a position to attempt the shot. When the person so attempts the shot the lower body positioning member restrains forward rotation of the person's leading shin. Preferably in addition to the lower body positioning member, but optionally alternative thereto, an upper body positioning member is supported by the support or the frame and is located in front of a torso area of the person. When the person attempts the shot, the upper body positioning member restrains downward rotation of the person's shooting arm.

In various implementations of the invention, at least one ball rack may hold a number of basketballs reachable by the person when in the position. There may be two such ball racks each secured to an associated upright of the frame. An elbow positioning member may confine outward rotation of the person's shooting elbow. The elbow positioning member may include a vertically-extending pad carried by the upper body positioning member. The positioning members may be height adjustable to accommodate different persons. The upper and lower body positioning members may be positioned to respectively contact a tricep area of the shooting arm and the leading shin upon threshold movement of such arm and shin. The upper body positioning member may be positioned to restrain (constrain or confine) movement of the upper shooting arm so that its elbow does not go below its shoulder. The lower body positioning member may be positioned to prevent movement of the leading knee beyond about one to about three inches (about 1.5 to about 7.5 cm) ahead of an initial knee position.

In another aspect, the invention is directed to a method for training a person to accomplish a desired basketball shot. A training apparatus is provided which defines a location for the person to utilize the apparatus. A basketball goal is provided. The apparatus is positioned relative to the goal so that the defined location has a desired relationship to the goal. The person is positioned in the defined location in a preferred stance for the desired shot. A first member of the apparatus is positioned in front of a lower portion of the person. A second member of the apparatus is positioned in front of an upper portion of the person. In a repetitive process, the person is provided with a basketball and shoots the basketball at the goal. During the shot, an initial squatting movement of the person, causing a lower leg of the person to rotate forward or beyond a threshold rotation, will be restrained by the first member. An initial movement of the person, otherwise causing an upper arm portion of the person's shooting arm to rotate down to or beyond a threshold rotation, will be restrained by the second member (preferably little to no rotation is permitted). By this repetitive process the person learns to accomplish the shot without excessive rotation of the lower leg and upper arm. Advantageously, the shooter receives balls from one or more racks positioned for access as close as possible to the desired initial position.

BRIEF DESCRIPTION OF THE DRAWINGS

The details of one or more embodiments of the invention are set forth in the accompanying drawings and the description below. Other features, objects, and advantages of the invention will be apparent from the description and drawings, and from the claims.

Like reference numbers and designations in the various drawings indicate like elements.

DETAILED DESCRIPTION OF THE PREFERRED EMBODIMENTS

Figure 1:
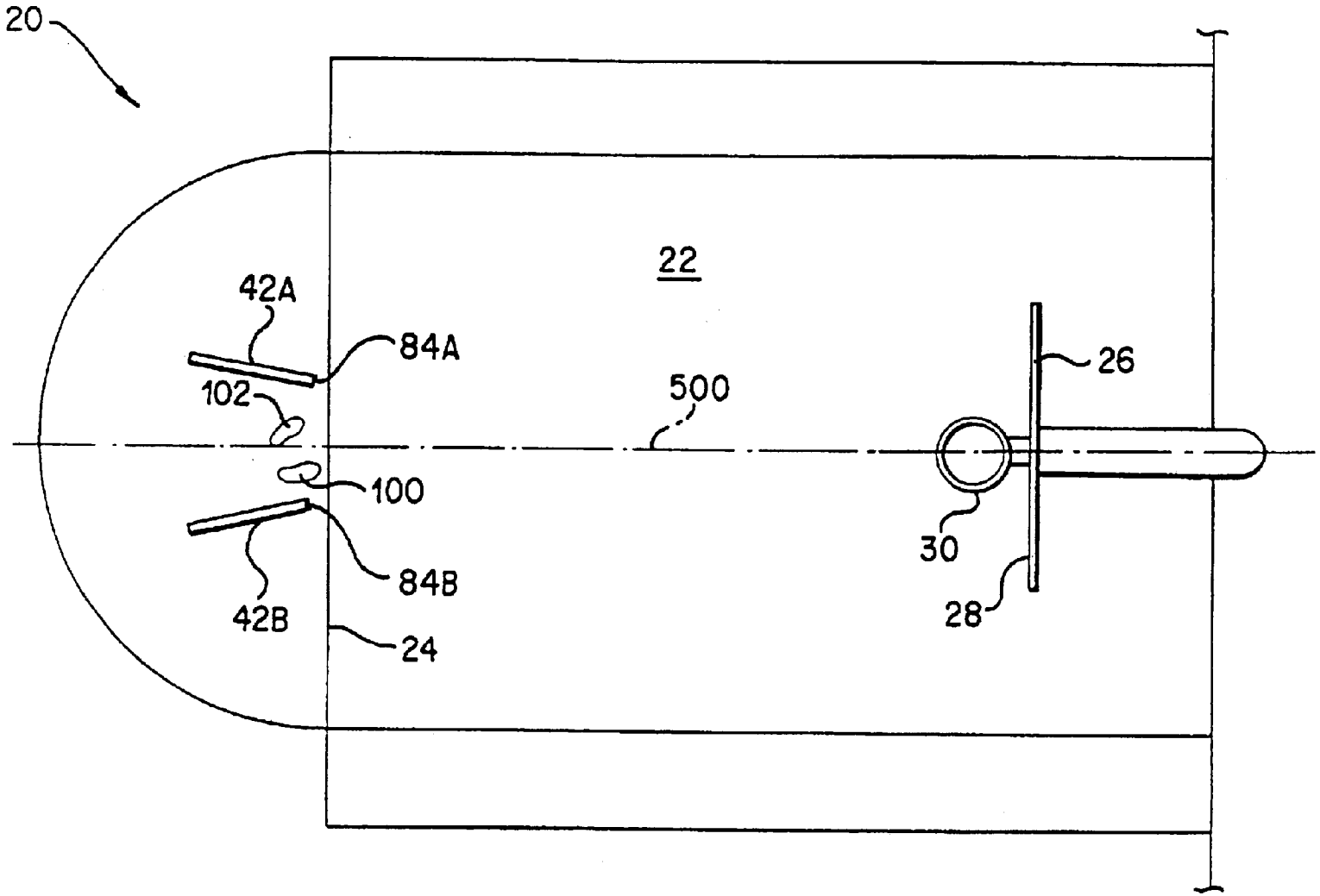
FIG. 1 is a top view of a basketball free-throw lane area.
Figure 2:
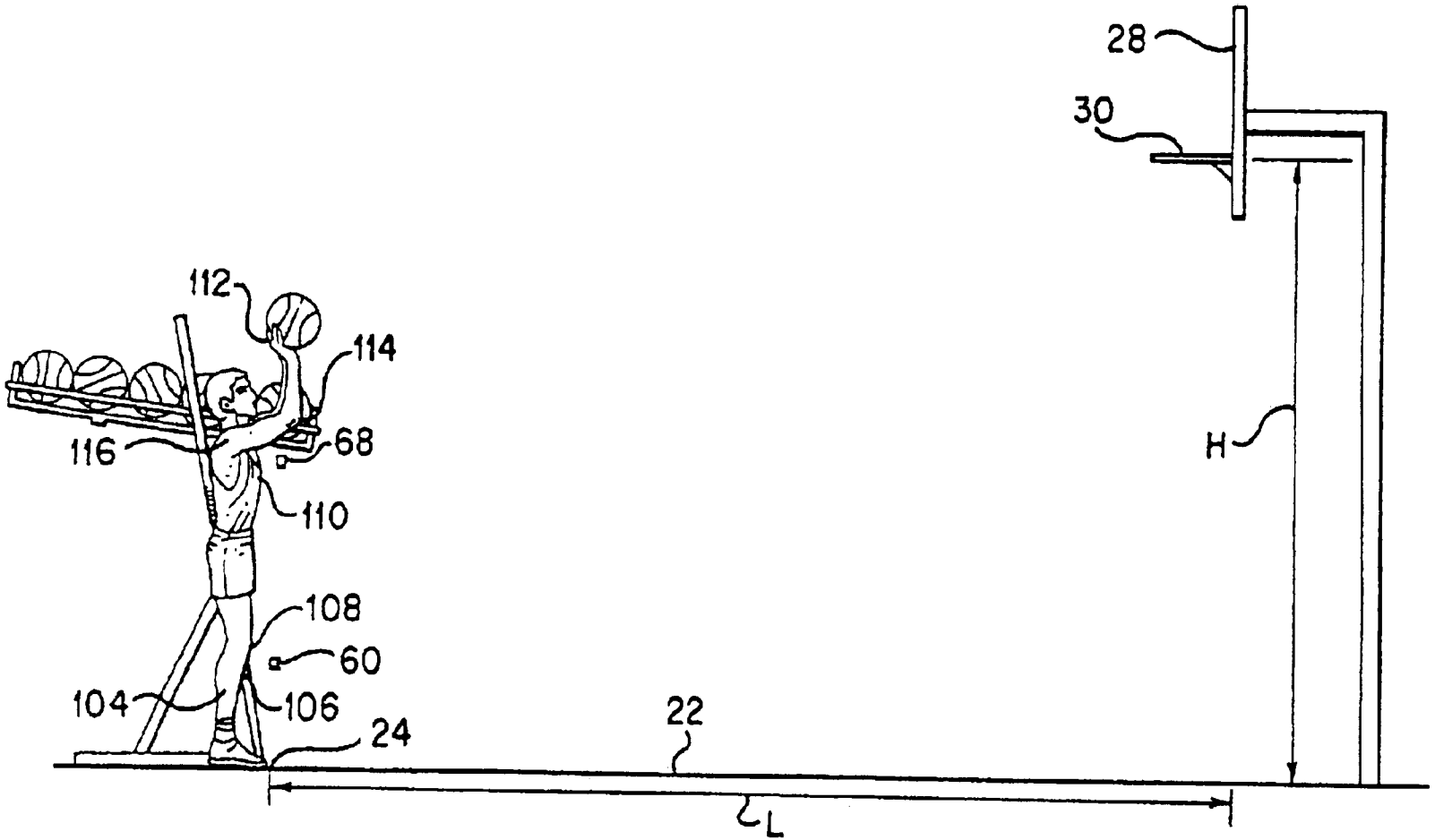
FIG. 2 is a partially schematic side view of a player preparing to shoot a free-throw with a free-throw training apparatus shown cut away.

FIG. 1 shows a free-throw lane of a basketball court 20. The court includes a floor 22 with a free-throw line 24 marked thereon. A backboard 26 is held above the floor 22 and has a front surface 28. A basket rim or ring 30 is secured in front of the backboard 26. As shown in FIG. 2, the plane of the front surface 28 is a distance L away from the front edge of the free-throw line 24 and the upper edge of the basket rim 30 is a height H above the floor 22 (FIG. 2). Under universal basketball standards, L and H are respectively fifteen and ten feet (4.57 and 3.05 m).

For a right handed shooter, it is believed that advantageous foot positions are shown in FIG. 1 for the shooter's right and left feet/shoes 100 and 102, respectively. The feet 100 and 102 are on opposite sides of the court centerline 500 so that the toe of the right shoe 100 is just behind (from the shooter's viewpoint) the free-throw line 24. The left foot 102 is in a toe-out orientation (pointed outward by approximately ten to thirty degrees more than is the right foot 100) and is set back so that the toe of the left shoe 102 is at least a few inches (for example, about two to eight inches (5 to 20 cm)) behind the front edge of the free-throw line 24.

Figure 3:
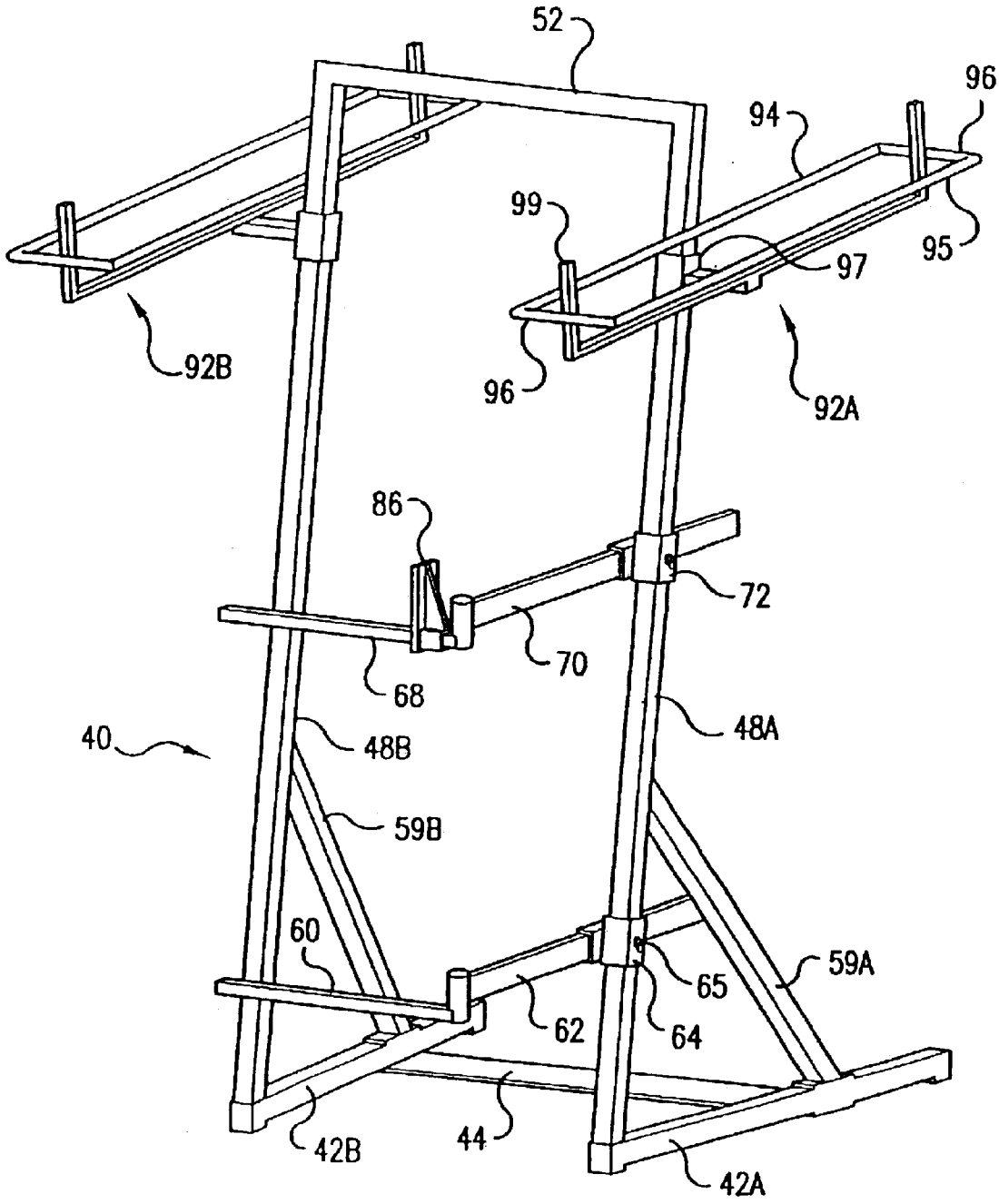
FIG. 3 is a view of a free-throw training apparatus according to principles of the invention.
Figure 4:
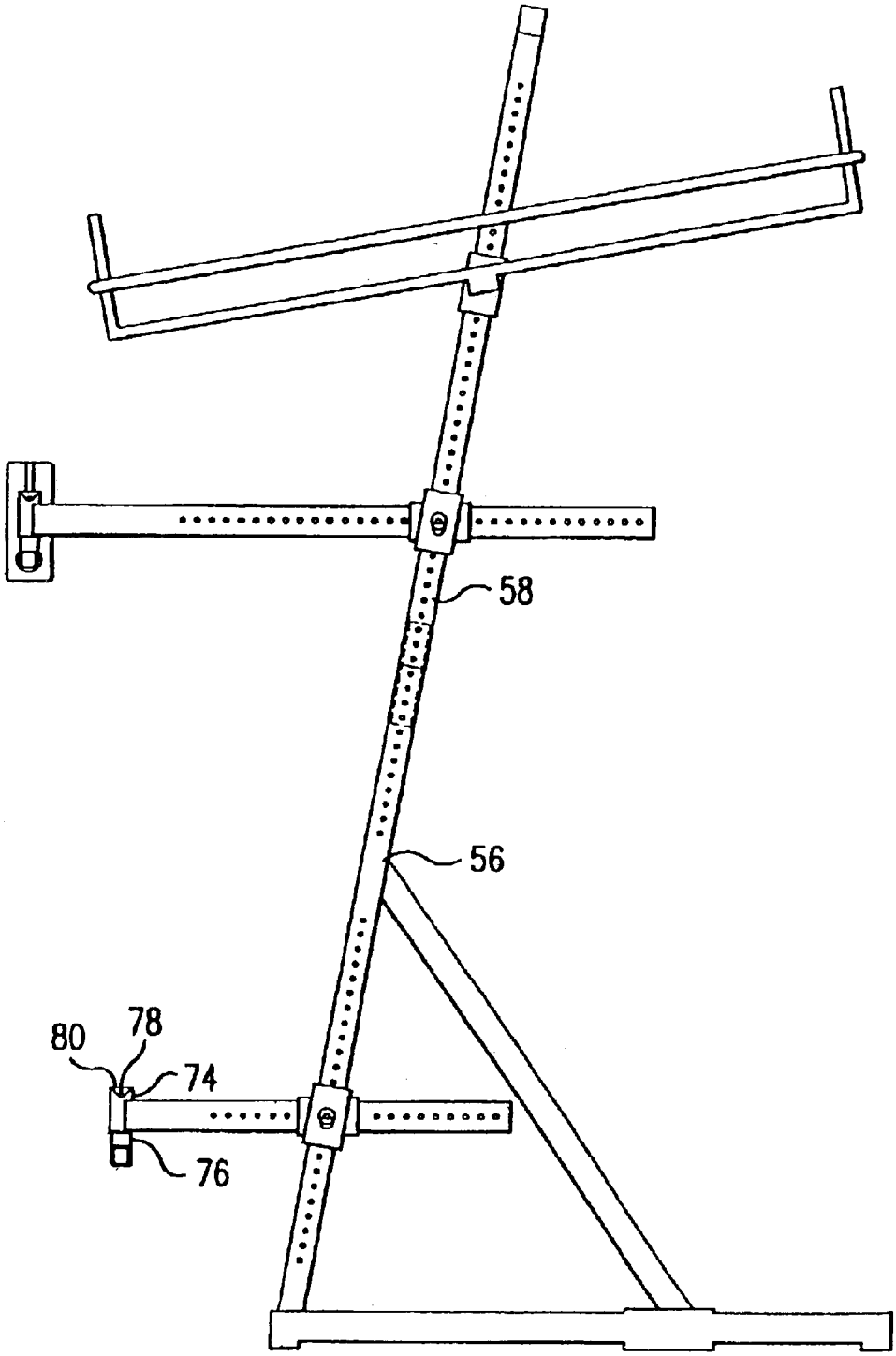
FIG. 4 is a side view of the free-throw training apparatus of FIG. 3.
Figure 5:
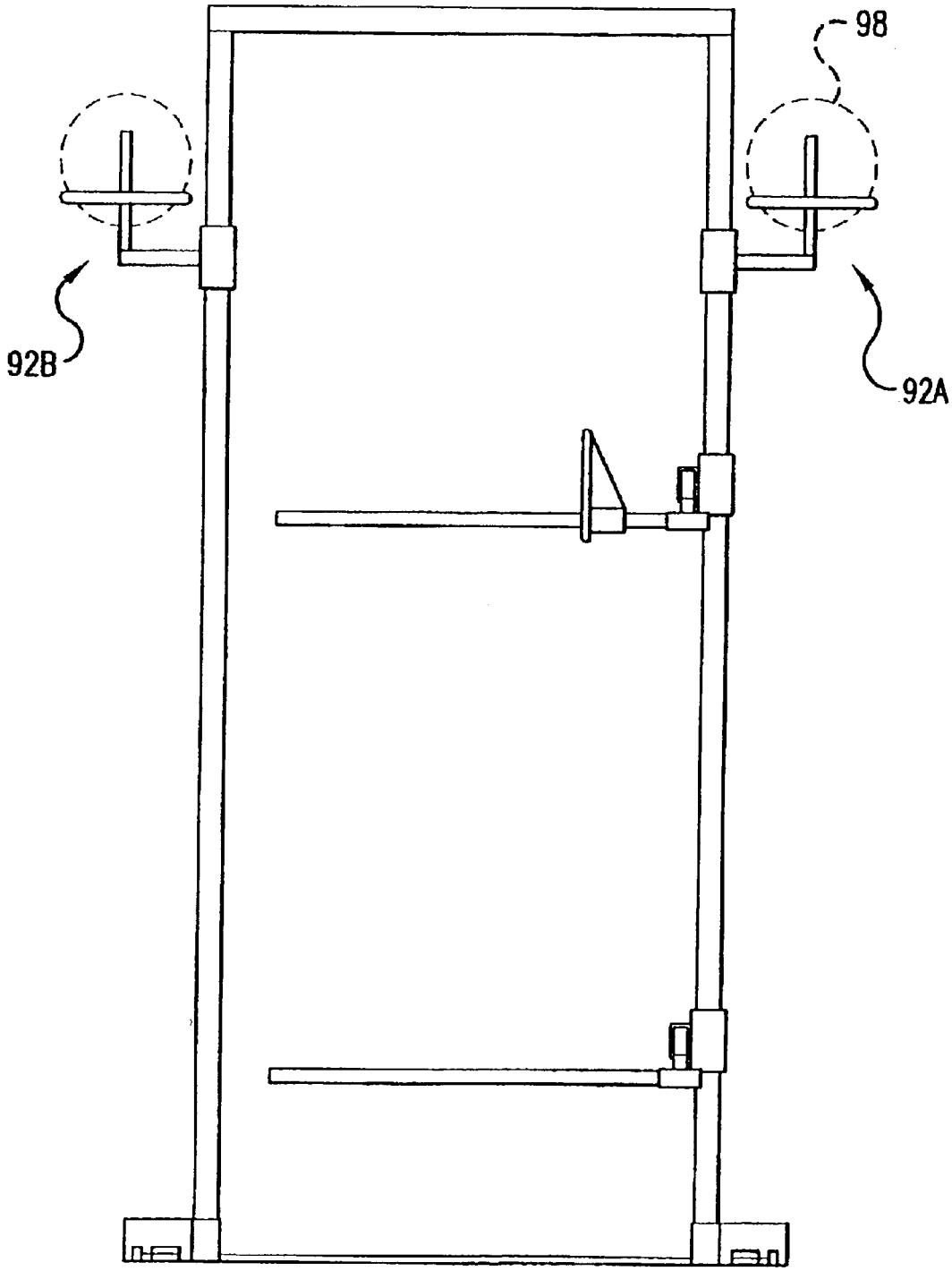
FIG. 5 is a front view of the free-throw training apparatus of FIG. 3.

FIGS. 3–5 show a training apparatus 40 according to principles of the invention. The apparatus 40 includes a base formed of left and right generally longitudinal members 42A and 42B and a transverse crossmember 44 joining the left 42A and right 42B members. The base members 42A and 42B may be permanently connected (such as by welding) or removably connected (such as by means of clamps). Exemplary longitudinal member material is two inch (5 cm) square section steel tubing having a 0.109 inch (0.28 cm) wall thickness while exemplary crossmember material is 6.0×⅜ inch (15×0.95 cm) steel bar stock to minimize interference with the user's feet. Extending upward from the base, a frame member includes left and right generally vertical members or uprights 48A and 48B secured at their lower ends to the base (e.g., at members 42A and 42B) such as by welding or by clamps. A cross member 52 of the frame connects the uprights 48A and 48B preferably adjacent to the upper ends thereof and is secured to the uprights 48A and 48B such as by interfitting, welding or clamps. Each upright 48A and 48B may include a lower portion 56 and an upper portion 58. Exemplary upright material is 1.75 inch (4.4 cm) square section steel tube having 0.120 inch (0.30 cm) wall thickness. Upper 58 and lower 56 portions may be secured to each other such as by means of an adapter tube (e.g., 1.5 inch (3.8 cm) square section by 0.95 inch (2.4 cm) wall thickness steel tube) telescoped within the portions 56 and 58 and spanning the joint between. The adapter may be welded to one of the portions 56 and 58 and secured to the other by a removable pin. Structurally reinforcing diagonal members 59A and 59B have upper ends secured to associated lower portions 56 of the uprights 48A and 48B and lower ends secured to associated longitudinal members 42A and 42B. Exemplary material for the diagonal members 59A and 59B is 1.75 inch (4.4 cm) square section by 0.095 inch (0.24 cm) thick steel tube.

Advantageously, the apparatus 40 has members 60 and 68 for restraining the shooter's setting movement when attempting the shot to provide feedback to the shooter. A horizontal crossarm 60 is secured at the distal end of a longitudinal arm 62 secured to one of the uprights (e.g., 48A) by means of a collar 64. The collar 64 may be supported by a pin 65 extending through holes on opposite sides of the associated upright. Exemplary holes may be at a pitch of 0.5 inch (1.27 cm) to provide height adjustment. A second crossarm 68 may similarly be secured at the distal end of a second longitudinal arm 70 secured to an upright (e.g., 48A) by means of a second such collar 72. In operation, the crossarm 60 is used to position and direct the shooter's leading shin while the crossarm 68 is used to position and direct the shooter's upper shooting arm. Therefore, the crossarm 68 is located substantially above the crossarm 60. Exemplary material for the longitudinal arms 62 and 70 is 2.0×1.0×0.072 inch (5×2.5×0.18 cm) wall thickness rectangular steel tube having an array of transverse through holes on 1.0 inch (2.5 cm) spacing to facilitate front-to-back position adjustment. Exemplary material for the crossarms 60 and 68 is 1.0 inch (2.5 cm) square section by 0.035 inch (0.09 cm) thick by 36.0 inch (91 cm) long steel tube.

To secure the crossarms 60 and 68 to the associated longitudinal arms 62 and 70, the latter may each, at their forward ends, bear a vertical inner tube 74 which receives a smaller vertical outer tube 76 secured to a proximal end of the associated crossarm (FIG. 4). A pin 78 carried by the inner tube 74 may bear against a rim of the outer tube 76 to vertically retain the crossarm 60. A relieved area or detent 80 may be provided to accommodate the pin 78 in a preferred transverse orientation of the crossarm 60. The crossarm 60 may be rotated about a central vertical axis of the inner 74 and outer 76 tubes producing a camming action of the pin 78 against the rim to allow ingress and egress from the apparatus 40. This provides the crossarm with a gravity-biased return to the transverse orientation.

FIG. 1 shows an operative position for the apparatus 40 with front ends 84A and 84B of the base members 42A and 42B just behind the free-throw line 24 and the crossarms 60 and 68 very close to the line 24. The preferred shooting position for the shooter is thus within the apparatus. It is noted that the "front" or "forward" direction for the apparatus faces the basket rim 30 just behind the free-throw line 24.

With the apparatus 40 so positioned relative to the free-throw line and the basket rim 30, and the shooter positioned in the preferred initial shooting position and stance (FIG. 2), the crossarms 60 and 68 may be positioned to provide the desired restraint and direction. Specifically, the crossarm 60 extends parallel to the free-throw line 24 and is located spaced in front of the lower leg 104 of the shooter, preferably, in front of an upper portion of the shooter's leading shin 106. For a right handed shooter, the separation is effective so that, upon a minimal flexion rotating the shooter's right knee 108 forward, his or her right shin will contact the crossarm 60 after the shin has rotated a given amount from its initial standing orientation. An exemplary movement involves the right knee 108 moving between about one and about three inches from its initial position. For a shooter with a two-foot long shin this involves a rotation of between about two degrees and about seven degrees. The crossarm 68 maybe positioned in front of the upper portion of the shooter's body. Specifically, it is located in front of the shooter's chest 110 at a desired height.

The shooter is provided with a basketball. An initial position of the shooter (FIG. 2) is standing generally upright, holding the basketball in his or her shooting hand 112 with the shooting elbow 114 pointed substantially forward elevated slightly relative to the shoulder 116 at a position spaced above the crossarm 68. The off hand (left hand of a right handed shooter, not shown) may be positioned supporting the basketball to the side of the shooting hand 112 with the off elbow (not shown) directed laterally.

Figure 6:
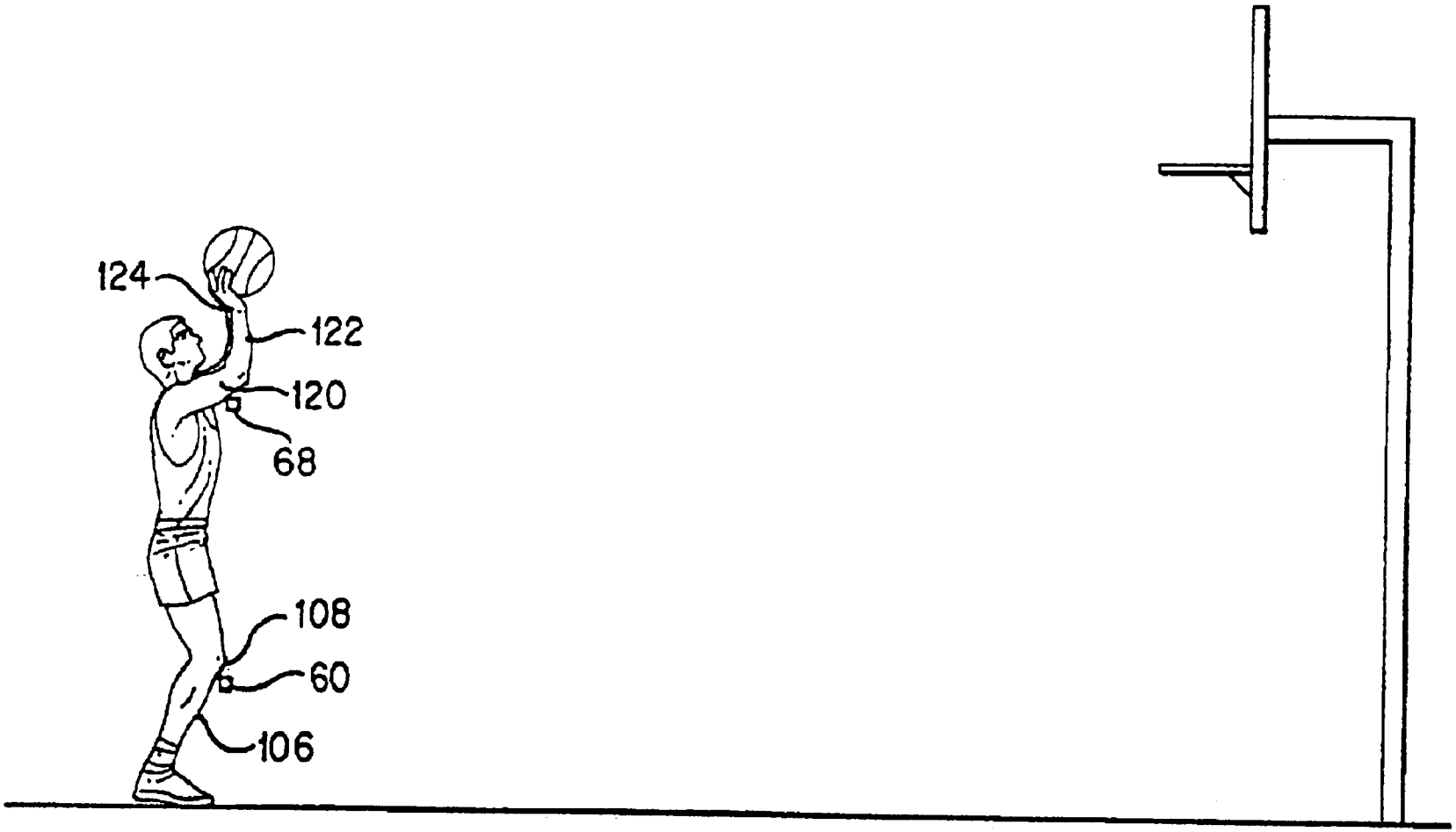
FIG. 6 is a semi-schematic side view of the player of FIG. 2 setting to take a free-throw shot.
Figure 7:
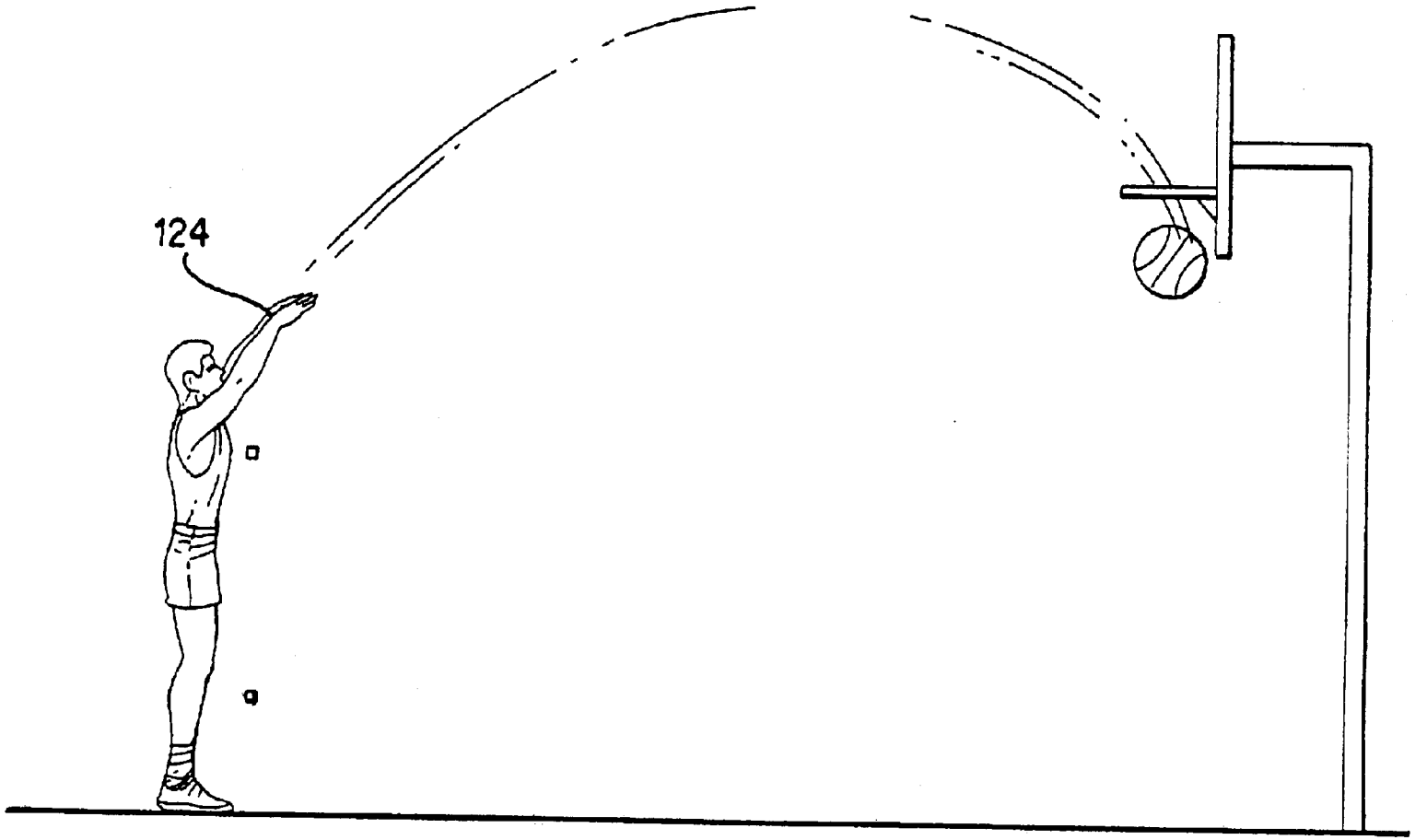
FIG. 7 is a semi-schematic side view of the player of FIG. 2 taking the shot.

When beginning to shoot the basketball, many shooters tend to initially squat while both lowering and flaring out their shooting elbow 114. The extremes of these motions are undesirable sources of shooting inaccuracy. Thus, any initial squatting movement will cause the shooter's lower legs to rotate forward, bringing the right shin (for a right handed shooter) into contact with the crossarm 60 (FIG. 6), restraining further forward rotation of the lower leg. Any squatting movement also lowers the shooter's torso. The crossarm 68 is advantageously positioned so that, given the desired restrained flexion, the backside (tricep area) 120 of the shooter's upper shooting arm 122 comes into contact with the crossarm 68 when the legs have rotated downward to the desired threshold with little to no downward rotation of the upper arm 122. Preferably, at this point, this threshold angle from the shoulder to the elbow is well above horizontal (e.g., in the vicinity of about thirty to forty degrees). Advantageously, the threshold angle is effective to prevent the ball from blocking the shooter's direct line of sight to the basket rim 30 so that the line of sight is continuous and uninterrupted. Upon encountering these restraints of leg and arm motion, the shooter then finishes the shot by extending his or her legs and arms and launching the ball with a flick of his or her wrist 124 (FIG. 7). The ball either goes through the basket rim 30 or misses. The process is repeated. The shooter is compelled to make the necessary positive adjustments to their mechanics to perform within the constraints dictated by the method and apparatus 40. For example, the apparatus 40 and method may initially locate the arms of the shooter nearer to the apex of the shot than the shooter is accustomed to at the start of the shooting process. The shooter may have to slightly adjust their technique over the first few shot attempts to adapt to the simplified movement to cleanly make the shot. The repetitions may continue until the shooter has trained themselves by ingraining the desired minimal flexion and movement and building the muscle memory to consistently accomplish the free-throw with the desired minimal motion. Since the shooter is not encumbered by devices attached to his or her body, when the apparatus 40 is removed, the shooter experiences no change in sensation and, thereby, is able to maintain the preferred repetitive motion achieved with use of the apparatus 40.

It should be appreciated that a number of options and modifications to the apparatus 40 are available. Further restraint may be provided. An example of such is the provision of a pad 86 (FIG. 3) or other barrier on the crossarm 68 and/or longitudinal arm 70 to restrain lateral movement of the shooter's shooting elbow. Advantageously, the pad 86 extends vertically and generally parallel to the court centerline 500. The transverse position of the pad 84 may be adjustable via sliding along the crossarm 68 and locking thereto by means of a screw clamp, release pin, detent mechanism, or the like. Although not believed advantageous, one of the crossarms could be omitted. For example, if the lower crossarm 60 were eliminated, the interaction of the upper crossarm 68 with the shooter's tricep would still tend to restrain the shooter's ability to squat.

Figure 8:
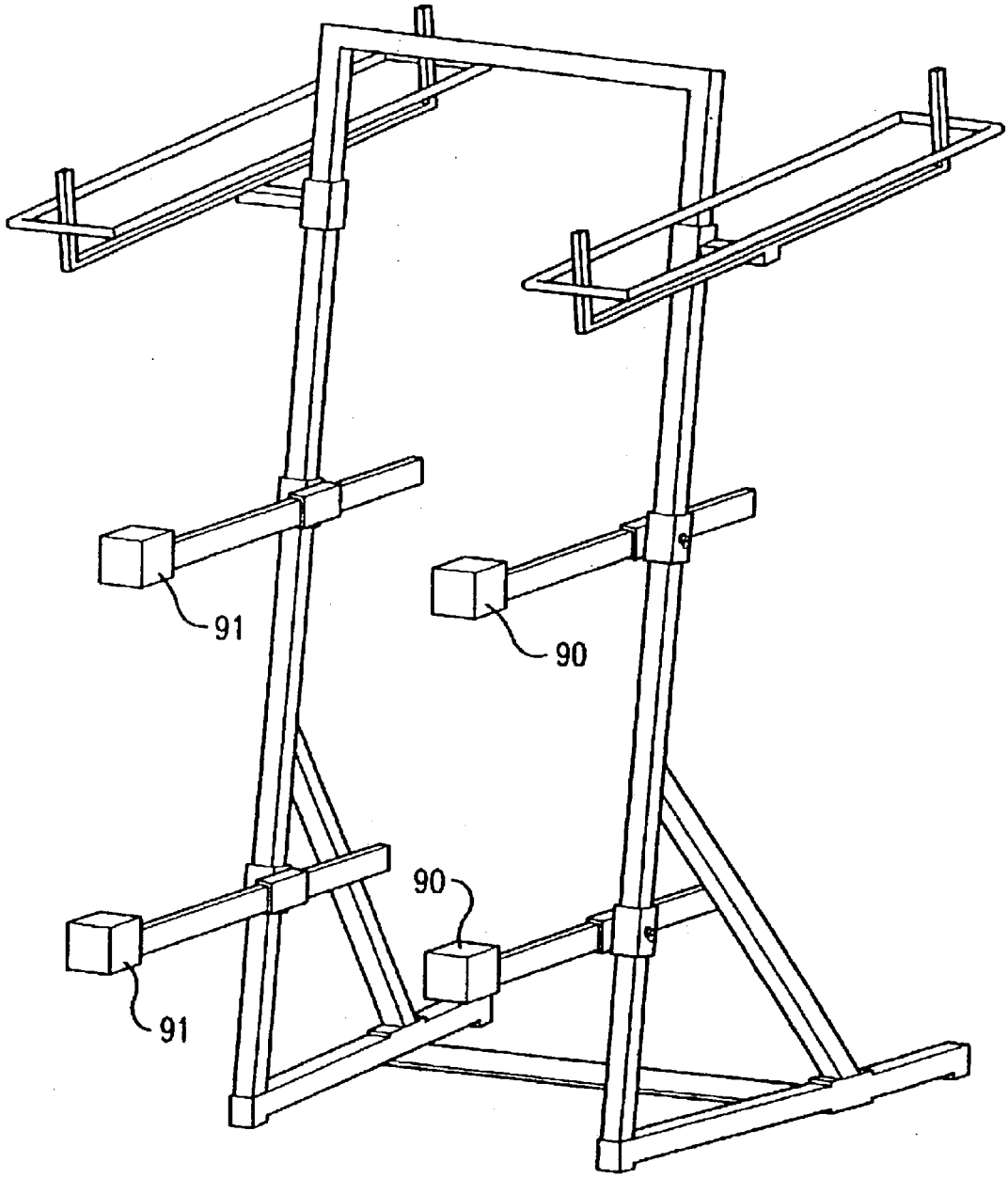
FIG. 8 is a view of a second free-throw training apparatus according to principles of the invention.

Furthermore, the various physical restraints which physically interrupt and stop motion may be replaced or enhanced by non-physical feedback restraints. For example, the crossarms 60 and 68 could be replaced by light beams with appropriate sources 90 and detectors 91 (FIG. 8). Interaction of the lower leg and upper arm with the light beams (for example, interrupting the beams) would cause electronic circuitry (not shown) to provide an audible tone or other feedback to the shooter indicating that his or her movement has met or exceeded a desired threshold. This feedback would be utilized to train the shooter to maintain their motion within a tolerable amount. Such an electronic system might be particularly useful in a high end professional training apparatus which could include various additional sensors and monitoring equipment such as a pressure sensor array on the floor to check the shooter's balance and a computer monitor to display the parameters of the shooter's form and performance.

Another advantageous feature of the apparatus 40 is the provision of one or more integrated ball racks. FIGS. 3 and 5 show left and right such racks 92A and 92B mounted on outboard sides of the respective left and right uprights 48A and 48B. Each rack includes inboard and outboard rails 94 and 95 connected by crossmembers 96. A collar or clamp 97 secures each of the racks 92A and 92B to an associated one of the uprights 48A and 48B. The racks 92A and 92B extend generally front to back and, in one embodiment, are angled downward in the forward direction. To prevent basketballs 98 carried by the racks 92A and 92B from rolling off, an upright 99 is provided at a front end of the racks 92A and 92B to block forward movement of the basketballs. The upright 99 may be formed as one vertical portion of a U-shaped member centrally connecting the rack crossmembers 96 and supported by the collar 97 to support the rack. In operation, the shooter removes the foremost basketball from the rack. Remaining basketballs roll forward such that a next basketball takes the place of a previous basketball. Providing a supply of basketballs on the racks 92A and 92B permits a shooter to execute a series of shots without having to move out of position to get another basketball and without the need for another individual to act as a feeder. Advantageous arrangement places at least five basketballs on each rack so that the shooter can shoot ten shots before stopping to collect basketballs and reload the racks 92A and 92B.

Although illustrated in FIGS. 3–5 configured for use by a left handed shooter, the apparatus is preferably convertible for use with right or left handed shooters or may be made ambidextrous without need for conversion. By way of example, the crossarms 60 and 68 and their associated longitudinal arms 62 and 70 may be removed from the left side of the apparatus 40 (e.g., attached to upright 48A) and mounted on the right side of the apparatus 40 (e.g., attached to upright 48B) to accommodate a right handed shooter. Alternatively, there could be two sets of crossarms 60 and 68 and longitudinal arms 62 and 70 with both sets being hinged (e.g., at the elbow or junction between the crossarm and longitudinal arm) or otherwise articulatable to allow one set to be placed in a stowed condition (e.g., where the crossarm rests against (parallel to) the longitudinal arm) while the other set is in a deployed condition (e.g., where the crossarm is perpendicular to the longitudinal arm) for use by the shooter.

As noted above, one or both crossarms 60 and 68 may be stowed or removed. With the upper 68 or lower 60 crossarm stowed, the user may, respectively, concentrate on movements of his or her lower or upper body. Stowing both crossarms 60 and 68 may help in verifying proper form. If the crossarms 60 and 68 are redeployed after a period of time, this may provide information on how well the shooter has imprinted the desired shot form. Optionally, deployment of only the lower crossarm 60 maybe useful to teach jump shooting. Deployment of only the upper crossarm 68 may be useful to simulate a defender. It should be appreciated that an additional attachment may be provided, for example to the upper crossarm 68, to more effectively simulate a defender.

Figure 9:
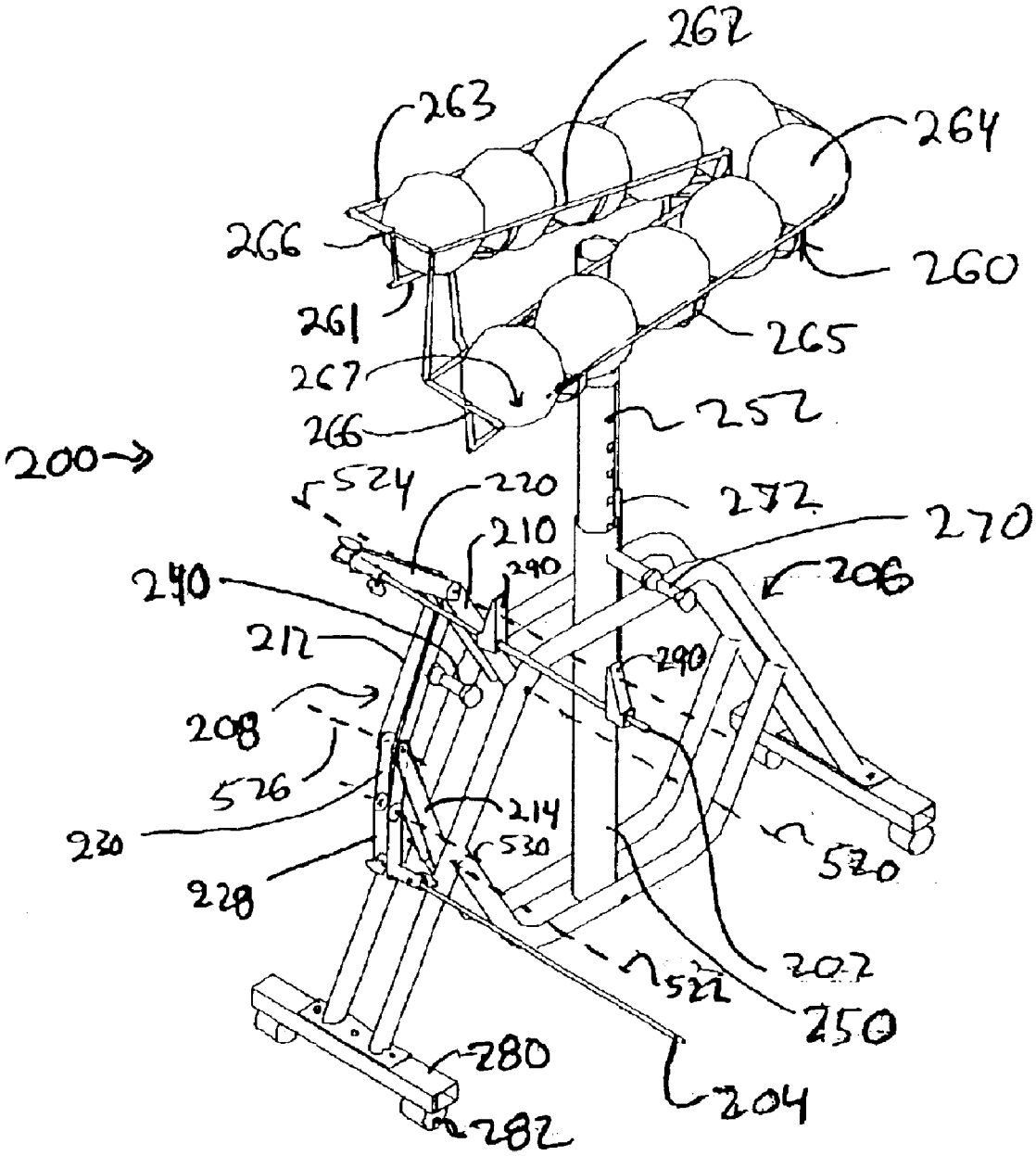
FIG. 9 is a view of a third free-throw training apparatus according to principles of the invention.

FIG. 9 shows an alternate apparatus 200 having upper and lower crossarms 202 and 204 which may be used in place of the crossarms 68 and 60, respectively. The exemplary crossarms 202 and 204 are mounted to a structural frame 206 via a four bar linkage 208 of which the frame 206 provides a first (rear) bar and pairs of parallel metal strips 210, 212 and 214 provide second (upper), third (forward), and fourth (lower) bars. Proximal ends of the second bar 210 and the fourth bar 214 are pivotally connected to the frame 206 for rotation about transverse axes 520 and 522. First and second ends of the third bar 212 are pivotally connected to the distal ends of the second bar 210 and the fourth bar 214 at respective axes 524 and 526. The crossarm 202 is mounted to the distal end of an arm 220 whose proximal end is pivotally mounted at the axis 524 and frictionally engaged to the third bar 212 so as to tend to maintain a given orientation relative to the third bar 212. For example, respective strips of the arm 220 maybe inboard of the strips of the third bar 212 and outwardly biased into frictional engagement therewith. The lower crossarm 204 is mounted to the distal end of an arm 228, the proximal end of which is pivotally mounted to the distal end of an arm 230 for relative rotation about a transverse axis 530. The proximal end of the arm 230 is mounted to the four bar linkage 208 at the axis 526.

The mass of the lower crossarm 204 and arms 228 and 230 tends to stabilize the four bar linkage 208 so that articulation of the four bar linkage, such as by raising and lowering a handle 240 tends to generally raise and lower the upper 202 and lower 204 crossarms together. Further and more precise adjustments of the relative and absolute positions of the crossarms may be obtained by articulating the arm 220 for the upper crossarm 202 and the arms 228 and 230 for the lower crossarm 204 in various combinations so as to provide a desired position.

The exemplary frame 206 includes a main vertical tube 250 into which is telescoped a second tube 252 extending upward therefrom. At its upper end, the tube 252 carries a ball rack 260 having a forwardly open U-shaped form when viewed from above and having a generally continuous downward slope from a tip of an outboard leg of the U-shape to a tip of an inboard leg of the U-shape to provide a gravity feed. The exemplary rack 260 is principally formed of a lower trackbar 261, an inner trackbar 262, and an outer trackbar 263. The lower bar 261 is positioned under the lower extremities of basketballs 264 positioned within the U-shaped rack 260. The inner 262 and outer 263 trackbars are positioned along inner and outer sides of the U-shaped grouping of basketballs 264 in a full rack. The exemplary bars 261, 262, and 263 are formed of bent steel rods connected to each other via a plurality of U-shaped steel straps 265 at various locations along their length and by T-shaped upper and lower end pieces 266. A gap 267 in the outer bar 263 adjacent to the lower end of the rack 260 allows a shooter to grab a lowermost basketball from beneath and remove it from the rack 260 without need to reposition the grasping hand, as the hand can pass through the gap 267. A similar gap may be formed in the lower bar 261.

The height of the rack is adjustable by raising and lowering the tube 252 within the tube 250 and locking the two tubes together via a pin means 270. An internal or external compression spring, pneumatic strut 272, or the like may be provided to counterbalance the weight of the rack

260 for ease of adjustment. For example, an external pneumatic strut 272 may be connected via ball joints to the tubes 250 and 252 along the rear portions thereof. The height adjustment is advantageous to permit the shoot to acquire balls from the rack 260 with the least possible movement. Advantageously, the height adjustment positions the rack 260 so that the lowermost ball is to the side and slightly forward of the shooter, positioned at a height of between about the shooter's shoulder and somewhat higher than the shooter's head. Base crossmembers 280 of the frame 206 may have casters 282 as means for facilitating movement of the apparatus 200.

A relatively simple elbow positioning member may take the form of one or two stiff foam blocks 290 having a transverse aperture dimensioned to be slid over the upper crossarm 202 in a press-fit engagement.

One or more embodiments of the present invention have been described. Nevertheless, it will be understood that various modifications may be made without departing from the spirit and scope of the invention. For example, a wide variety of materials and construction techniques may be utilized. Fixed or deployable wheels, rollers, or the like may be added for ease of mobility. The uprights need not be exactly vertical and the longitudinal members need not exactly extend longitudinally and horizontally. Rather, the former is advantageously sufficiently vertical to deploy the key components such as one or both of the crossarms and the ball racks while the latter should be effective to provide a relatively unintrusive base. The apparatus may be alternately configured, especially if additional or fewer features are desired. Although most relevant to foul shots, the apparatus and method may be applied to teaching proper technique for accomplishing other shots. Accordingly, other embodiments are within the scope of the following claims.

What is claimed is:

1. A device for training a person to accomplish a basketball shot, comprising:

a frame member;

at least one linkage assembly pivotally connected to said frame member, said at least one linkage assembly configured to be vertically and horizontally adjustably positioned with respect to said frame member; and at least one of:

a lower body positioning member supported by said at least one linkage assembly and configured to be vertically and horizontally adjustably positioned with respect to said frame member so as to be located in front of a leg area of said person when said person is positioned to attempt a shot such that when said person performs an unaided range of motion and shoots said basketball said lower body positioning member is configured to restrain forward rotation of said person's leading shin beyond a threshold rotation; and an upper body positioning member supported by said at least one linkage member and configured to be vertically and horizontally adjustably positioned with respect to said frame member so as to be located in front of a torso area of said person in said position such that that when said person attempts said shot said upper body positioning member is configured to restrain downward rotation of said person's shooting arm beyond a threshold rotation;

wherein by repeatedly shooting said basketball with said device, said person learns a desired range of motion for shooting said basketball absent said device without excessive rotation of said lower leg and upper arm.

2. A device for training a person to accomplish a basketball shot, comprising;

a frame member;

at least one linkage assembly pivotally connected to said frame member, said at least one linkage assembly configured to be vertically and horizontally adjustably positioned with respect to said frame member;

at least one of:

a lower body positioning member supported by said at least one linkage assembly and configured to be vertically and horizontally adjustably positioned with respect to said frame member so as to be located in front of a leg area of said person when said person is positioned to attempt a shot such that when said person attempts said shot said lower body positioning member is configured to restrain forward rotation of said person's leading shin; and an upper body positioning member supported by said at least one linkage member and configured to be vertically and horizontally adjustably positioned with respect to said frame member so as to be located in front of a torso area of said person in said position such that that when said person attempts said shot said upper body positioning member is configured to restrain downward rotation of said person's shooting arm; and a rack holding a plurality of basketballs within reach of said person when said person is in said position.

3. The device of claim 2 wherein said rack is comprised of a forwardly open U-shaped form, said rack having a generally continuous downward slope to provide a gravity feed of basketballs to said person in said position.

4. The device of claim 2 further comprising;

a main vertical tube; and a second tube having an upper and a lower end, said upper end supporting said rack and said lower end disposed within said main vertical tube in a telescoping relation such that a height of said second tube is adjustable.

5. The device of claim 4 further comprising a lock for locking said second tube at a desired height.

6. The device of claim 2 wherein said rack is comprised of a forwardly open U-shaped form, said rack having a generally continuous downward slope to provide a gravity feed of basketballs to said person in said position.

7. The device of claim 2 further comprising at least one upright connected to said frame member, and wherein said rack is comprised of a pair of ball racks coupled to said upright, each of said ball racks having a generally continuous downward slop to provide a gravity feed of basketballs to a first side and a side opposite to said first side of said person in said position.

8. The device of claim 2, wherein:

said lower body positioning member is comprised of a first light source and a first detector; and wherein said restraint of rotation of said person's leading shin is by feedback responsive to interaction of said leading shin with a beam extending between said first light source and said first detector; and said upper body positioning member is comprised of a second light source and a second detector, and wherein said restraint of rotation of said person's shooting arm is by feedback responsive to interaction of said shooting arm with a beam extending between said second light source and said second detector.

9. The device of claim 1 further comprising a rack holding a plurality of basketballs within reach of said person when said person is positioned to attempt a basketball shot.

10. The device of claim 9 wherein said rack is comprised of a forwardly open U-shaped form, said rack having a generally continuous downward slope to provide a gravity feed of basketballs to said person in said position.

11. The devise of claim 1 wherein said at least one linkage assembly comprises:

an upper bar pivotally coupled to said frame member for rotation about an upper axis;

a lower bar pivotally coupled to said frame member rotation about a lower axis; and a forward bar pivotally coupled to distal ends of said upper bar about a first axis and said lower bar about a second axis.

12. The device of claim 11, further comprising:

an upper arm pivotally mounted to said first axis and frictionally engaged to said forward bar so as to tend to maintain a given orientation relative to said forward bar;

wherein said upper body positioning member is mounted to a distal end of said upper arm.

13. The device of claim 12, further comprising:

a first lower arm pivotally mounted to said second axis; and a second lower arm pivotally mounted to said first lower arm about a third axis;

wherein said lower body positioning member is mounted to a distal end of said second lower arm.

14. The device of claim 13, wherein a mass of said lower body positioning member, said second lower arm and said first lower arm stabilizes said linkage assembly so that articulation of said linkage assembly raises and lowers said lower body positioning member and said upper body positioning member together.

15. The device of claim 1, wherein:

said lower body positioning member is comprised of a first light source and a first detector, and wherein said restraint of rotation of said person's leading shin is by feedback responsive to interaction of said leading shin with a beam extending between said first light source and said first detector; and said upper body positioning member is comprised of a second light source and a second detector, and wherein said restraint of rotation of said person's shooting arm is by feedback responsive to interaction of said shooting arm with a beam extending between said second light source and said second detector.

16. A device for training a person to accomplish a basketball shot, comprising;

a frame member;

at least one linkage assembly pivotally connected to said frame member; and at least one of:

a lower body positioning member supported by said at least one linkage assembly and located in front of a leg area of said person when said person is positioned to attempt a shot such that when said person attempts said shot said lower body positioning member restrains forward rotation of said person's leading shin; and an upper body positioning member supported by said at least one linkage member and located in front of a torso area of said person in said position such that that when said person attempts said shot said upper body positioning member restrains downward rotation of said person's shooting arm;

wherein said at least one linkage assembly comprises:

an upper bar pivotally coupled to said frame member for rotation about an upper axis;

a lower bar pivotally coupled to said frame member for rotation about a lower axis; and a forward bar pivotally coupled to distal ends of said upper bar about a first axis and said lower bar about a second axis.

17. The device of claim 16, further comprising:

an upper arm pivotally mounted to said first axis and frictionally engaged to said forward bar so as to tend to maintain a given orientation relative to said forward bar;

wherein said upper body positioning member is mounted to a distal end of said upper arm.

18. The device of claim 16, further comprising:

a first lower arm pivotally mounted to said second axis; and a second lower arm pivotally mounted to said first lower arm about a third axis;

wherein said lower body positioning member is mounted to a distal end of said second lower arm.

19. The device of claim 18, wherein a mass of said lower body positioning member, said second lower arm and said first lower arm stabilizes said linkage assembly so that articulation of said linkage assembly raises and lowers said lower body positioning member and said upper body positioning member together.

20. The device of claim 19, further comprising a handle mounted to said linkage assembly to assist articulation thereof.

21. The device of claim 16, wherein:

said lower body positioning member is comprised of a first light source and a first detector, and wherein said restraint of rotation of said person's leading shin is by feedback responsive to interaction of said leading shin with a beam extending between said first light source and said first detector; and said upper body positioning member is comprised of a second light source and a second detector, and wherein said restraint of rotation of said person's shooting arm is by feedback responsive to interaction of said shooting arm with a beam extending between said second light source and said second detector.

* * * * *